US011181117B2

(12) United States Patent
Suzuki et al.

(10) Patent No.: US 11,181,117 B2
(45) Date of Patent: Nov. 23, 2021

(54) CEILING FAN

(71) Applicant: Panasonic Intellectual Property Management Co., Ltd., Osaka (JP)

(72) Inventors: Fumiya Suzuki, Aichi (JP); Hiroyuki Kuramochi, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 800 days.

(21) Appl. No.: 16/070,498

(22) PCT Filed: Jan. 19, 2017

(86) PCT No.: PCT/JP2017/001640
§ 371 (c)(1),
(2) Date: Jul. 16, 2018

(87) PCT Pub. No.: WO2017/126575
PCT Pub. Date: Jul. 27, 2017

(65) Prior Publication Data

US 2021/0199118 A1 Jul. 1, 2021

(30) Foreign Application Priority Data

Jan. 21, 2016 (JP) ..... JP2016-009721

(51) Int. Cl.
*F04D 25/08* (2006.01)
*F21V 33/00* (2006.01)
*F04D 29/64* (2006.01)

(52) U.S. Cl.
CPC ..... *F04D 25/088* (2013.01); *F04D 29/644* (2013.01); *F21V 33/0096* (2013.01)

(58) Field of Classification Search
CPC .... F04D 25/088; F04D 29/644; F04D 29/582; F04D 25/06; F21V 33/0096; F21V 29/70; F21V 29/773; F21V 29/83; F21V 19/0015; F21V 15/01; F21V 19/004; F21V 19/0045; F21Y 2115/10
See application file for complete search history.

(56) References Cited

FOREIGN PATENT DOCUMENTS

JP 2015-055157 A 3/2015

*Primary Examiner* — Joseph L Williams
*Assistant Examiner* — Jose M Diaz
(74) *Attorney, Agent, or Firm* — McDermott Will & Emery LLP

(57) ABSTRACT

A first protrusion protruding from an upper lighting cover is fitted into a first installing portion provided in a cover and a second protrusion protruding from the upper lighting cover is inserted into a first hole provided in the cover. In a case where disassembly is performed from this state, disassembly can be accomplished by breaking a first breaking portion provided around the first installing portion. In a case where reassembly is performed from this state, the second protrusion protruding from the upper lighting cover is fitted into a second installing portion provided in the cover.

4 Claims, 5 Drawing Sheets

CEILING FAN

CROSS REFERENCE

This application is the U.S. National Phase under 35 U.S.C. § 371 of International Application No. PCT/JP2017/001640 filed on Jan. 19, 2017, which claims the benefit of Japanese Application No. 2016-009721 filed on Jan. 21, 2016, the entire contents of each are hereby incorporated by reference.

TECHNICAL FIELD

The present invention relates to a ceiling fan.

BACKGROUND ART

A ceiling fan of the related art provided with lighting is configured of a support rod, a motor, blades, and a lighting unit. Here, the support rod engages the ceiling fan with a ceiling. The motor is provided at a lower portion of the support rod. The blades are rotated by the motor. The lighting unit is provided at a lower portion of the motor.

CITATION LIST

Patent Literature

PTL 1: Japanese Patent Unexamined Publication No. 2015-55157

SUMMARY OF THE INVENTION

The ceiling fan of the related art assumes that the lighting unit has to be disassembled for some reason such as repair or a manufacturing process, and the lighting unit has a structure which can be reassembled after disassembly. Since the lighting unit having such a structure can be easily disassembled, it is possible to perform illegal remodeling. Therefore, there is a problem that it is necessary to have a structure that can be easily disassembled and furthermore can prevent illegal remodeling.

A ceiling fan according to an aspect of the invention includes a lighting unit. The lighting unit includes an upper lighting cover; a lower lighting cover provided at a lower portion of the upper lighting cover; a light-emitting unit that is disposed between the upper lighting cover and the lower lighting cover; and a cover provided at an upper portion of the upper lighting cover. The lower lighting cover and the upper lighting cover are fixed to each other by cover fixing portions, and the cover fixing portions are provided in the lower lighting cover, the upper lighting cover, and the cover. The upper lighting cover includes a first protrusion and a second protrusion both protruding from the upper lighting cover toward the cover side. The cover includes a first installing portion in which the first protrusion is fitted, a first hole in which the second protrusion is positioned when the first protrusion is fitted in the first installing portion, a second installing portion in which the second protrusion is fitted, a third hole in which the first protrusion is positioned when the second protrusion is fitted in the second installing portion and a first breaking portion around the first installing portion, the first breaking portion capable of breaking. When the cover is attached to the upper lighting cover by fitting of the first protrusion in the first installing portion, the second protrusion is positioned in the first hole. When the cover with the first protrusion fitted in the first installing portion is detached from the upper lighting cover, the first breaking portion is broken. When the cover with the first breaking portion broken is attached to the upper lighting cover, (i) the upper lighting cover, the lower lighting cover, and the cover are fixed together by the cover fixing portions, (ii) the second protrusion is fitted in the second installing portion, and (iii) the first protrusion is positioned in the third hole. Therefore, an intended object can be obtained.

In the ceiling fan according to an aspect of the invention, the first protrusion is fitted in the first installing portion, and when the cover and the upper lighting cover are fixed, the first protrusion is fitted in the first installing portion and the second protrusion is positioned in the first hole. When the cover with the first protrusion fitted in the first installing portion is detached from the upper lighting cover, the first breaking portion is broken. When the cover with the first breaking portion broken is attached to the upper lighting cover, (i) the upper lighting cover, the lower lighting cover, and the cover are fixed together by the cover fixing portions, (ii) the second protrusion is fitted in the second installing portion, and (iii) the first protrusion is positioned in the third hole. Therefore, even in a case where the lighting unit has to be disassembled for some reason such as repair or a manufacturing process, while preventing illegal remodeling by making the structure which cannot be easily disassembled without destruction, the lighting unit can be reassembled after disassembly.

DESCRIPTION OF EMBODIMENT

Hereinafter, an embodiment will be described with reference to the drawings.

Figure 1:
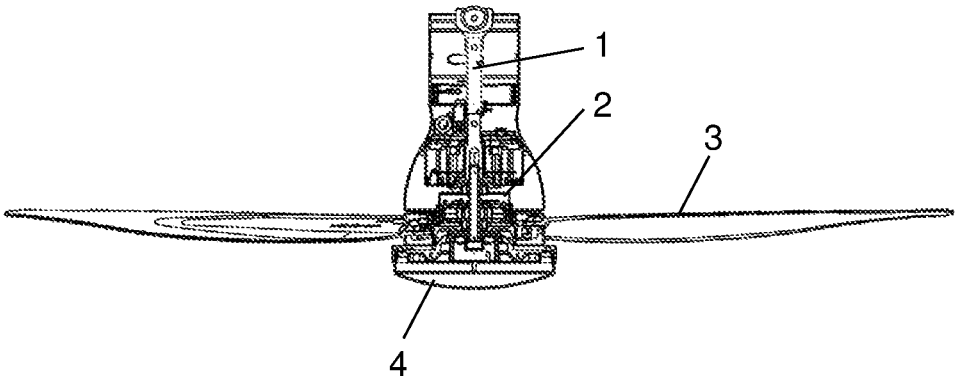
FIG. 1 is a view for explaining a ceiling fan according to an embodiment.

In addition, with respect to each member described below, a portion on an upper side in FIG. 1 is referred to as an upper portion and a portion on a lower side in FIG. 1 is referred to as a lower portion. In addition, a surface on the upper side in FIG. 1 is referred to as an upper surface and a surface on the lower side in FIG. 1 is referred to as a lower surface. In addition, upward in FIG. 1 is referred to as upward and downward in FIG. 1 is referred to as downward.

EMBODIMENT

FIG. 1 is a view for explaining a ceiling fan according to an embodiment. As illustrated in FIG. 1, the ceiling fan includes support rod 1, motor 2, blades 3, and lighting unit 4.

An upper portion of support rod 1 is capable of engaging with a ceiling and motor 2 is fixed to a lower portion thereof. Motor 2 includes a plurality of blades 3 which are detachably attached. Blades 3 are fixed so as to extend outward from motor 2 in a horizontal direction. Motor 2 rotates, so that blades 3 rotate and air is blown. Lighting unit 4 is fixed to a lower portion of motor 2.

Figure 2:
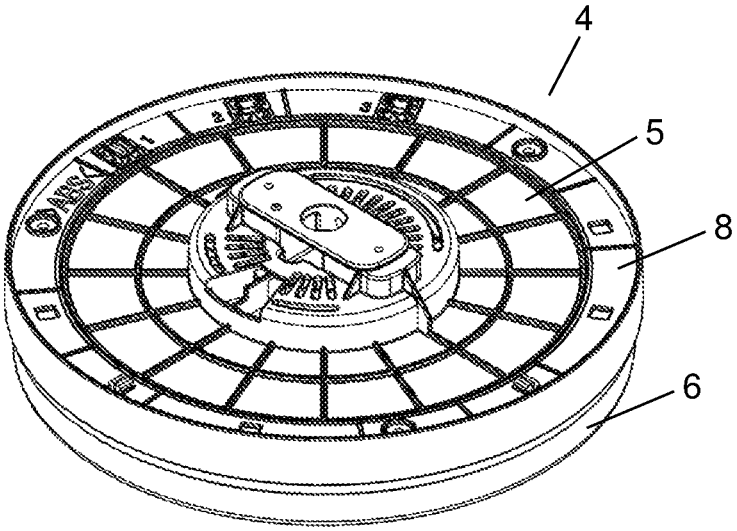
FIG. 2 is a perspective view of a lighting unit of the ceiling fan according to the embodiment.
Figure 3:
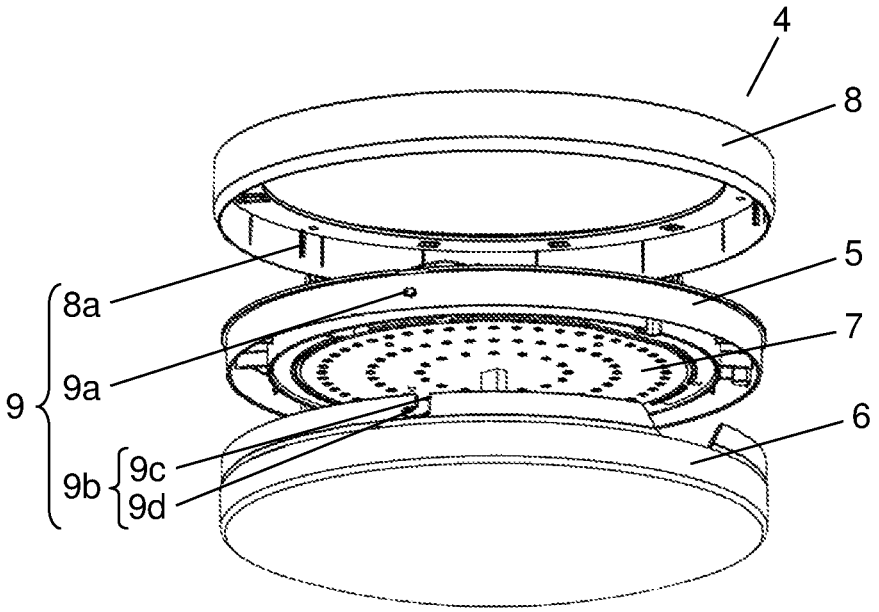
FIG. 3 is an exploded perspective view of the lighting unit of the ceiling fan according to the embodiment.

FIG. 2 is a perspective view of the lighting unit of the ceiling fan according to the embodiment. FIG. 3 is an exploded perspective view of the lighting unit of the ceiling fan according to the embodiment.

As illustrated in FIGS. 2 and 3, lighting unit 4 is configured of upper lighting cover 5, lower lighting cover 6, LED board 7, and cover 8. Upper lighting cover 5 is provided at the lower portion of motor 2 (see FIG. 1). Lower lighting cover 6 is provided at a lower portion of upper lighting cover 5. LED board 7 is an example of a light-emitting unit according to the present disclosure and is disposed between upper lighting cover 5 and lower lighting cover 6, and a plurality of light emitting elements are installed. Cover 8 is provided between motor 2 and upper lighting cover 5. When the plurality of the light emitting elements of LED board 7 emit light, an outside of a main body is illuminated with the light via lower lighting cover 6. Moreover, the light-emitting unit may be a light emitting body other than the Light Emitting Diode (LED), for example, a fluorescent lamp.

Upper lighting cover 5 has a substantially cylindrical shape of which an upper portion is closed, and is provided with upper fixing portion 9*a* that is a protrusion protruding outward from a cylindrical side surface on the cylindrical side surface.

Lower lighting cover 6 has a bowl shape which is opened upward and is provided with lower fixing portion 9*b* that is an L-shaped notch at an upper end portion. Lower fixing portion 9*b* includes first notch 9*c* which extends downward from an upper end of lower lighting cover 6 and second notch 9*d* which extends in the horizontal direction from a lower end of first notch 9*c*. A material of lower lighting cover 6 is a translucent resin, for example, polycarbonate.

LED board 7 is fixed to upper lighting cover 5 and is covered by fixing lower lighting cover 6 to upper lighting cover 5.

Cover 8 has a shape including a planar ring and a cylindrical side surface extending from an outer periphery of the ring, and covers a peripheral portion of the upper surface of upper lighting cover 5, the side surface of upper lighting cover 5, and an upper end portion of lower lighting cover 6. Ribs extending in a vertical direction protrude on an inside of the side surface of cover 8. The ribs are retaining portions 8*a*.

Upper lighting cover 5 and lower lighting cover 6 are fixed by cover fixing portions 9. Cover fixing portions 9 each includes upper fixing portion 9*a*, lower fixing portion 9*b*, and retaining portion 8*a*. Cover fixing portions 9 are provided at three positions at equal intervals in a peripheral edge. That is, an angle formed by adjacent cover fixing portions 9, upper lighting cover 5, and a center of cover 8 is 120 degrees.

In the configuration described above, a method of assembling upper lighting cover 5, lower lighting cover 6, LED board 7, and cover 8 will be described.

First, lower lighting cover 6 is covered with upper lighting cover 5 to which LED board 7 is fixed. In this case, lower lighting cover 6 is covered with upper lighting cover 5 so that the protrusion, which is upper fixing portion 9*a* of upper lighting cover 5, enters second notch 9*d* via first notch 9*c* that is in lower fixing portion 9*b* of lower lighting cover 6. Therefore, upper fixing portion 9*a* of upper lighting cover 5 is caught by second notch 9*d*, lower lighting cover 6 can move in the horizontal direction with respect to upper lighting cover 5, but cannot move in the vertical direction, and lower lighting cover 6 is held by upper lighting cover 5.

Next, upper lighting cover 5 and lower lighting cover 6 are covered with cover 8. In this case, cover 8 covers upper lighting cover 5 and lower lighting cover 6, so that a lower end portion of retaining portion 8*a* of cover 8 enters second notch 9*d* via first notch 9*c* that is in lower fixing portion 9*b* of lower lighting cover 6. Therefore, when lower lighting cover 6 moves in the horizontal direction with respect to upper lighting cover 5, upper fixing portion 9*a* of upper lighting cover 5 is in contact with the lower end portion of retaining portion 8*a* of cover 8 and lower lighting cover 6 cannot move with respect to upper lighting cover 5.

In a case where lower lighting cover 6 is detached from upper lighting cover 5, a reverse procedure is performed. That is, unless cover 8 is first detached from upper lighting cover 5 and lower lighting cover 6, lower lighting cover 6 is not removed from upper lighting cover 5.

Figure 4:
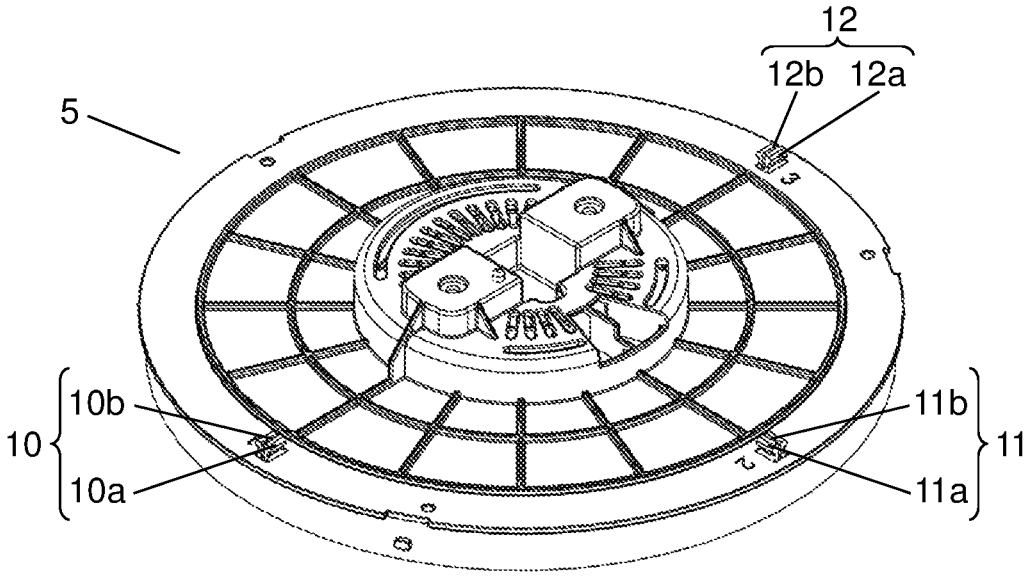
FIG. 4 is a perspective view of an upper lighting cover of the ceiling fan according to the embodiment.
Figure 5:
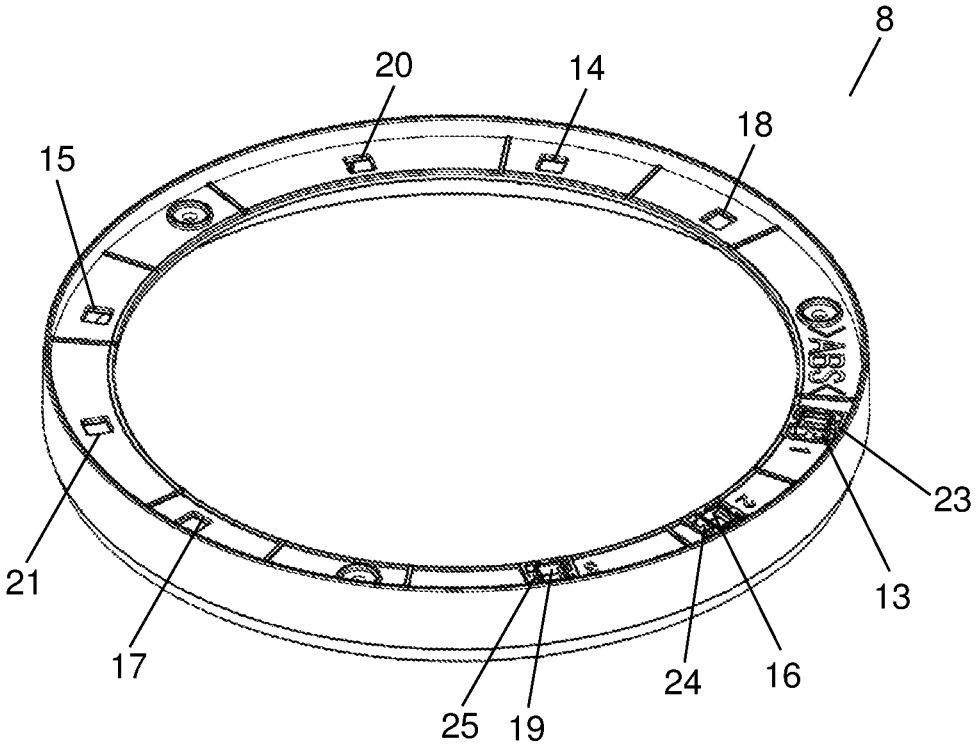
FIG. 5 is a perspective view of a cover of the ceiling fan according to the embodiment.
Figure 6:
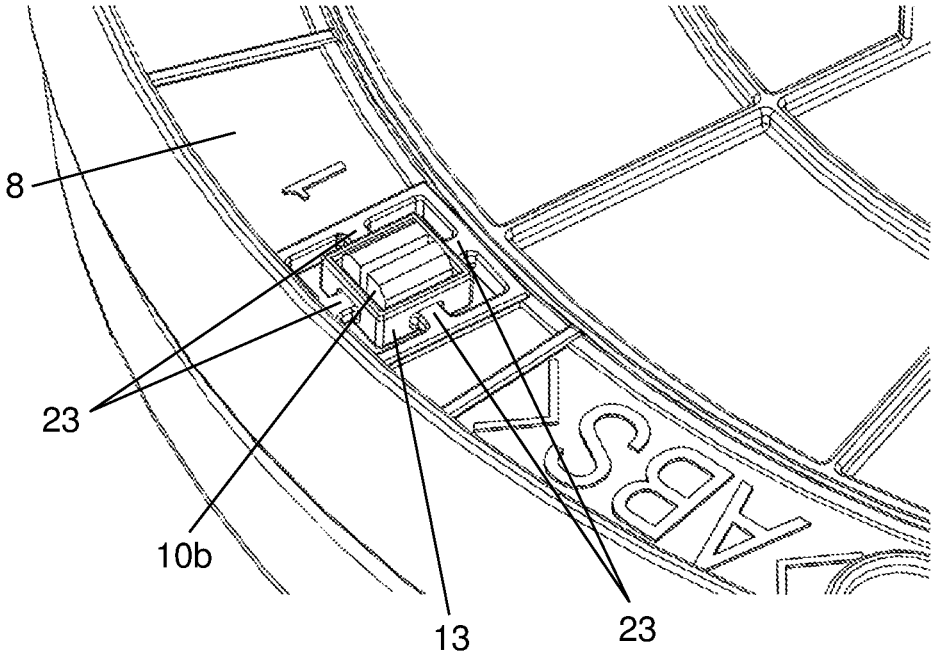
FIG. 6 is an enlarged view of the cover of the ceiling fan according to the embodiment.

FIG. 4 is a perspective view of the upper lighting cover of the ceiling fan according to the embodiment. FIG. 5 is a perspective view of the cover of the ceiling fan according to the embodiment. FIG. 6 is an enlarged view of the cover of the ceiling fan according to the embodiment.

As illustrated in FIG. 4, upper lighting cover 5 includes first protrusion 10, second protrusion 11, and third protrusion 12 protruding from an upper surface of upper lighting cover 5. An angle formed by two lines, one being connected between first protrusion 10 and the center of upper lighting cover 5 and the other being connected between second protrusion 11 and the center of upper lighting cover 5, is 90 degrees in counterclockwise. An angle formed by two lines, one being connected between second protrusion 11 and the center of upper lighting cover 5 and the other being connected between third protrusion 12 and the center of upper lighting cover 5, is 90 degrees in counterclockwise. An angle formed by two lines, one being connected between third protrusion 12 and the center of upper lighting cover 5 and the other being connected between first protrusion 10 and the center of upper lighting cover 5, is 180 degrees in counterclockwise.

First protrusion 10 includes two first flat plate portions 10*a* and first hook 10*b* at respective two first flat plate portions 10*a*.

Two first flat plate portions 10*a* have horizontally elongated flat plate shapes protruding upward from a peripheral portion of an upper surface of upper lighting cover 5, and two main surfaces face each other and are adjacent to each other. There is a gap between two adjacent first flat plate portions 10*a*. First hook 10*b* is a protrusion extending in the horizontal direction on a side opposite to the gap between first flat plate portions 10*a* from tips of respective first flat plate portions 10*a*. First flat plate portion 10*a*, upper lighting cover 5, and first hook 10*b* are integrally formed, for example, of a resin material, and first flat plate portion 10*a* has flexibility. Since there is the gap between two adjacent first flat plate portions 10*a*, it is possible to bend and attract two first flat plate portions 10*a*.

Second protrusion 11 and third protrusion 12 have the same shape as that of first protrusion 10, second protrusion 11 includes two second flat plate portions 11*a* and second hook 11*b*, and third protrusion 12 includes two third flat plate portions 12*a* and third hook 12*b*.

As illustrated in FIG. 5, the peripheral portion of the upper surface of cover 8 includes first installing portion 13 into which first protrusion 10 is fitted, and in this case, first hole 14 in which second protrusion 11 enters, and second hole 15 in which third protrusion 12 enters.

As illustrated in FIG. 6, first installing portion 13 has a quadrangular cylindrical shape of which a central axis extends in the vertical direction. When first protrusion 10 is inserted from below first installing portion 13, two first flat plate portions 10*a* (see FIG. 4) enter first installing portion 13 while being bent and attracted, and when first hook 10*b* passes through first installing portion 13, two first flat plate portions 10*a* return to original positions and first hook 10*b* is caught by an upper end portion of first installing portion 13. First installing portion 13 may have, for example, a circular shape, an elliptical circular shape, or another shape.

As illustrated in FIG. 5, first hole 14 and second hole 15 are quadrangular holes. When viewing first hole 14 from above, since first hole 14 is larger than second protrusion 11 (see FIG. 4) and third protrusion 12, when second protrusion 11 inserted into first hole 14, second flat plate portion 11*a* does not bend and second protrusion 11 enters first hole 14. Similarly, when viewing second hole 15 from above, since second hole 15 is larger than third protrusion 12 (see FIG. 4), when third protrusion 12 inserted into second hole 15, third flat plate portion 12*a* does not bend and third protrusion 12 enters second hole 15.

As illustrated in FIG. 6, first breaking portions 23 which are capable of breaking are provided around first installing portion 13. First breaking portions 23 are square prisms extending outward from four peripheral planes of quadrangular cylindrical first installing portion 13 and perpendicular to the four peripheral planes respectively. A gap is provided between cover 8 and first installing portion 13, and first installing portion 13 and cover 8 are connected by the four square prisms. First installing portion 13, first breaking portion 23, and cover 8 are integrally formed of a resin material. It is possible to cut first breaking portion 23 that is the square prism by inserting a tip of a tool such as a nipper into the gap between cover 8 and first installing portion 13. First breaking portion 23 may be held by one or more pieces, and a shape of first breaking portion 23 may be, for example, a cylindrical shape or another shape.

As illustrated in FIG. 5, cover 8 includes second installing portion 16 into which second protrusion 11 is fitted, and in this case, third hole 17 in which first protrusion 10 is positioned, and fourth hole 18 in which third protrusion 12 is positioned. In addition, cover 8 includes third installing portion 19 into which third protrusion 12 is fitted, and in this case, fifth hole 20 in which first protrusion 10 is positioned, and sixth hole 21 in which second protrusion 11 is positioned. Second installing portion 16 and third installing portion 19 have the same shape as that of first installing portion 13. In addition, third hole 17, fourth hole 18, fifth hole 20, and sixth hole 21 have the same shape as those of first hole 14 and second hole 15.

An angle formed by two lines, one being connected between first installing portion 13 and the center of cover 8 and the other being connected between second installing portion 16 and the center of cover 8, is 30 degrees in clockwise. An angle formed by two lines, one being connected between second installing portion 16 and the center of cover 8 and the other being connected between third installing portion 19 and the center of cover 8, is 30 degrees in clockwise. An angle formed by two lines, one being connected between third installing portion 19 and the center of cover 8 and the other being connected between first installing portion 13 and the center of cover 8, is 60 degrees in clockwise.

Second breaking portions 24 which are capable of breaking are provided around second installing portion 16 and third breaking portions 25 which are capable of breaking are provided around third installing portion 19. Second breaking portion 24 and third breaking portion 25 have the same shape as that of first breaking portion 23.

In the configuration described above, as illustrated in FIG. 7, a case where cover 8 is fixed to upper lighting cover 5 by first protrusion 10 and first installing portion 13 will be described.

Figure 7:
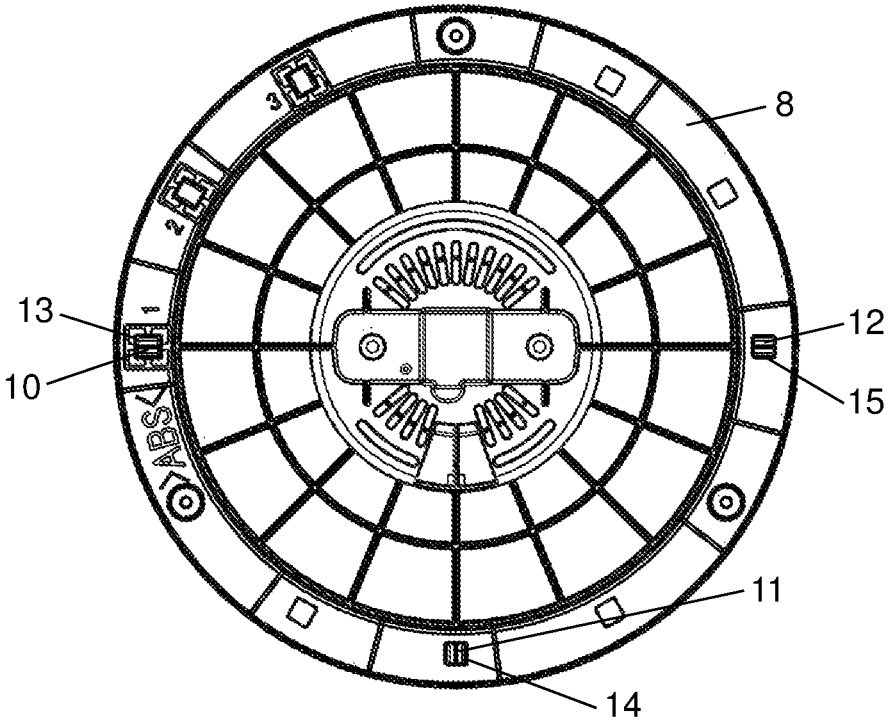
FIG. 7 is a plan view of the lighting unit of the ceiling fan according to the embodiment.

FIG. 7 is a plan view of the lighting unit of the ceiling fan according to the embodiment. Specifically, FIG. 7 is a plan view for explaining a state of lighting unit 4 in a case where first protrusion 10 is fitted into first installing portion 13 so that upper lighting cover 5 and cover 8 are fixed.

First, as illustrated in FIG. 3, upper lighting cover 5 and lower lighting cover 6 are fixed by cover fixing portion 9. As illustrated in FIG. 7, first protrusion 10 is fitted into first installing portion 13, second protrusion 11 enters first hole 14, and third protrusion 12 enters second hole 15. First installing portion 13 and first protrusion 10 are fixed by a fixing member or by processing first protrusion 10. An example of the fixing member is adhesive. An example of processing is to crush first protrusion 10 from above with heat and weld first protrusion 10 to first installing portion 13. An angle formed by two lines, one being connected between first installing portion 13 and the center of cover 8 and the other being connected between first hole 14 and the center of cover 8, is 90 degrees in counterclockwise. An angle formed by two lines, one being connected between first hole 14 and the center of cover 8 and the other being connected between second hole 15 and the center of cover 8, is 90 degrees in counterclockwise.

As illustrated in FIG. 3, in a case where upper lighting cover 5 and lower lighting cover 6 are removed from this state, first breaking portions 23 (see FIG. 6) of first installing portion 13 are broken. As illustrated in FIG. 3, cover 8 is removed from upper lighting cover 5 and upper lighting cover 5 and lower lighting cover 6 which are fixed by cover fixing portion 9 are detached.

Figure 8:
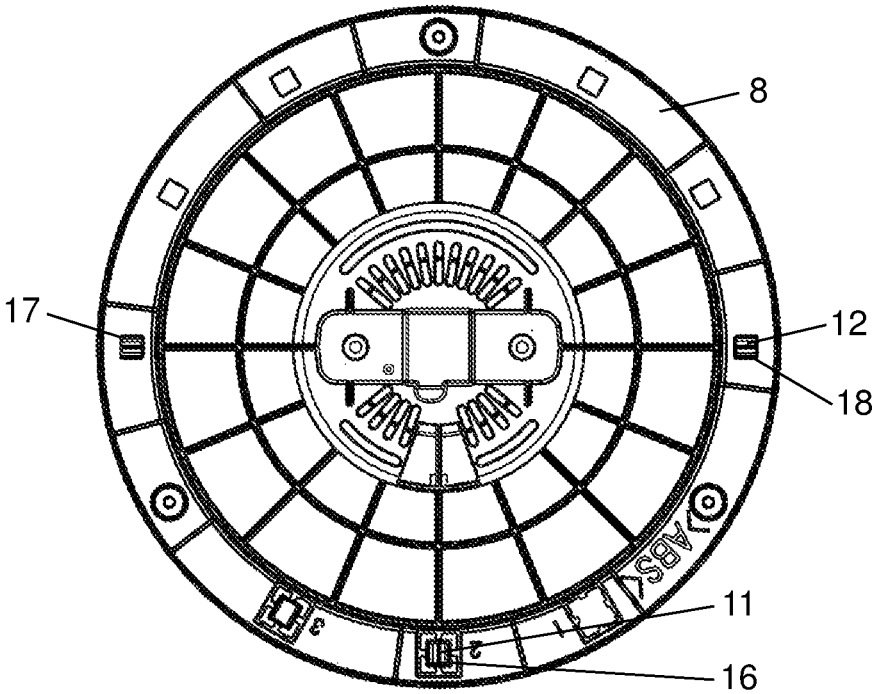
FIG. 8 is a plan view of the lighting unit of the ceiling fan according to the embodiment.

FIG. 8 is a plan view of the lighting unit of the ceiling fan according to the embodiment. Specifically, FIG. 8 is a plan view for explaining a state of lighting unit 4 in a case where second protrusion 11 is fitted into second installing portion 16 from a state where first breaking portion 23 is broken so that upper lighting cover 5 and cover 8 are fixed.

As illustrated in FIG. 8, in a case where once first breaking portions 23 (see FIGS. 5 and 6) are broken from cover 8 of the state of FIG. 7 and then reassembly is performed from a state where first installing portion 13 is separated, first flat plate portion 10*a* (see FIG. 4) of first protrusion 10 is cut. First installing portion 13 is removed from first protrusion 10 from the state illustrated in FIG. 7. As illustrated in FIG. 3, upper lighting cover 5 and lower lighting cover 6 are fixed by cover fixing portion 9. As illustrated in FIG. 8, second protrusion 11 is fitted into second installing portion 16, a cutting mark of first protrusion 10 enters third hole 17, and third protrusion 12 enters fourth hole 18. Second installing portion 16 and second protrusion 11 are fixed by a fixing member or by processing second protrusion 11. An angle formed by two lines, one being connected between second installing portion 16 and the center of cover 8 and the other being connected between third hole 17 and the center of cover 8, is 90 degrees in clockwise. An angle formed by two lines, one being connected between second installing portion 16 and the center of cover 8 and the other being connected between fourth hole 18 and the center of cover 8, is 90 degrees in counter-clockwise.

Similarly, as illustrated in FIG. 3, in a case where upper lighting cover 5 and lower lighting cover 6 are removed from this state, second breaking portion 24 (see FIG. 5) of second installing portion 16 is broken. As illustrated in FIG. 3, cover 8 is removed from upper lighting cover 5 and upper lighting cover 5 and lower lighting cover 6 which are fixed by cover fixing portion 9 are detached.

Figure 9:
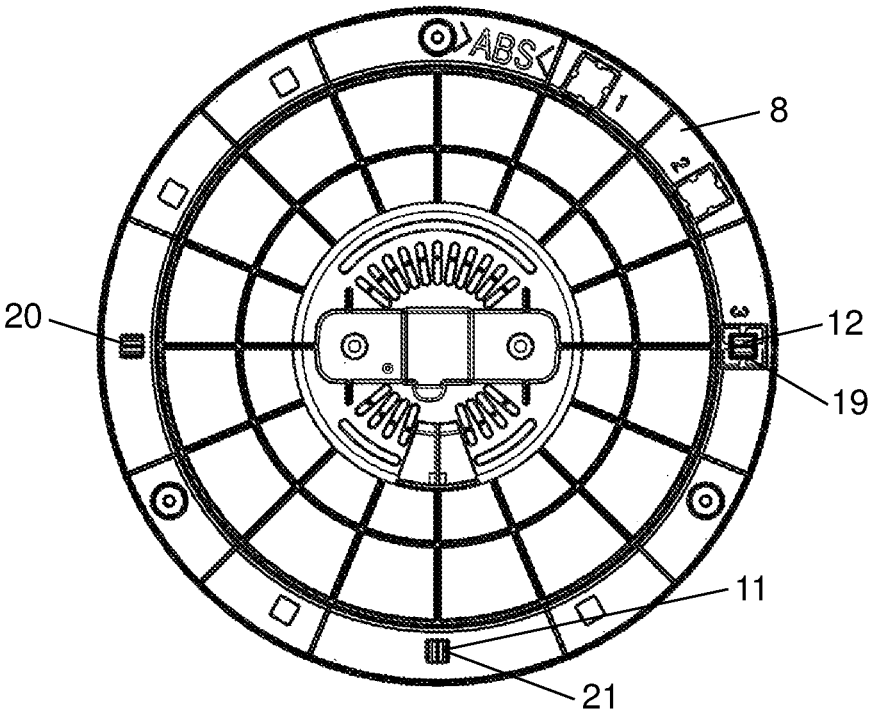
FIG. 9 is a plan view of the lighting unit of the ceiling fan according to the embodiment.

FIG. 9 is a plan view of the lighting unit of the ceiling fan according to the embodiment. Specifically, FIG. 9 is a plan view for explaining a state of lighting unit 4 in a case where third protrusion 12 is fitted into third installing portion 19 from a state where first breaking portion 23 and second breaking portion 24 are broken so that upper lighting cover 5 and cover 8 are fixed.

As illustrated in FIG. 9, in a case where once second breaking portions 24 (see FIG. 5) are broken from cover 8 of the state of FIG. 8 and then reassembly is performed from a state where second installing portion 16 is separated, second flat plate portion 11*a* (see FIG. 4) of second protrusion 11 is cut. Second installing portion 16 is removed from second protrusion 11 from the state illustrated in FIG. 8. As illustrated in FIG. 3, upper lighting cover 5 and lower lighting cover 6 are fixed by cover fixing portion 9. As illustrated in FIG. 9, third protrusion 12 is fitted into third installing portion 19, the cutting mark of first protrusion 10 enters fifth hole 20, and a cutting mark of second protrusion 11 enters sixth hole 21. Third installing portion 19 and third protrusion 12 are fixed by a fixing member or by processing third protrusion 12. An angle formed by two liens, one being connected between third installing portion 19 and the center of cover 8 and the other being connected between fifth hole 20 and the center of cover 8, is 180 degrees in counter clockwise. An angle formed by two lines, one being connected between third installing portion 19 and the center of cover 8 and the other being connected between sixth hole 21 and the center of cover 8, is 90 degrees in clockwise. Cover 8 may be additionally fixed to upper lighting cover 5 by screwing.

Therefore, even in a case where the lighting unit has to be disassembled for some reason such as repair or a manufacturing process, while preventing illegal remodeling by making the structure which cannot be easily disassembled without destruction, the lighting unit can have a structure which can be reassembled after disassembly.

INDUSTRIAL APPLICABILITY

The ceiling fan according to the present invention is useful as a ceiling fan for domestic use or office use.

REFERENCE MARKS IN THE DRAWINGS

1 SUPPORT ROD
2 MOTOR
3 BLADE
4 LIGHTING UNIT
5 UPPER LIGHTING COVER
6 LOWER LIGHTING COVER
7 LED BOARD (LIGHT-EMITTING UNIT)
8 COVER
9 COVER FIXING PORTION
10 FIRST PROTRUSION
10*a* FIRST FLAT PLATE PORTION
10*b* FIRST HOOK
11 SECOND PROTRUSION
11*a* SECOND FLAT PLATE PORTION
11*b* SECOND HOOK
12 THIRD PROTRUSION
12*a* THIRD FLAT PLATE PORTION
12*b* THIRD HOOK
13 FIRST INSTALLING PORTION
14 FIRST HOLE
15 SECOND HOLE
16 SECOND INSTALLING PORTION
17 THIRD HOLE
18 FOURTH HOLE
19 THIRD INSTALLING PORTION
20 FIFTH HOLE
21 SIXTH HOLE
23 FIRST BREAKING PORTION
24 SECOND BREAKING PORTION
25 THIRD BREAKING PORTION

The invention claimed is:

1. A ceiling fan comprising:
a lighting unit including:
an upper lighting cover;
a lower lighting cover disposed at a lower portion of the upper lighting cover;
a light-emitting unit disposed between the upper lighting cover and the lower lighting cover; and
a cover disposed at an upper portion of the upper lighting cover,
wherein the lower lighting cover and the upper lighting cover are fixed to each other by cover fixing portions,
wherein the cover fixing portions are provided in the lower lighting cover, the upper lighting cover, and the cover,
wherein the upper lighting cover includes a first protrusion and a second protrusion both protruding from the upper lighting cover toward the cover,
wherein the cover includes:
a first installing portion in which the first protrusion is fitted;
a first hole in which the second protrusion is positioned when the first protrusion is fitted in the first installing portion;
a second installing portion in which the second protrusion is fitted;
a third hole in which the first protrusion is positioned when the second protrusion is fitted in the second installing portion; and
a first breaking portion around the first installing portion, the first breaking portion being capable of breaking,
wherein when the cover is attached to the upper lighting cover by fitting of the first protrusion in the first installing portion, the second protrusion is positioned in the first hole,
wherein when the cover with the first protrusion fitted in the first installing portion is detached from the upper lighting cover, the first breaking portion is broken, and
wherein when the cover with the first breaking portion being broken is attached to the upper lighting cover, (i) the upper lighting cover, the lower lighting cover, and the cover are fixed together by the cover fixing portions, (ii) the second protrusion is fitted in the second installing portion, and (iii) the first protrusion is positioned in the third hole.

2. The ceiling fan of claim 1,
wherein the first protrusion includes a first hook having flexibility, wherein when the first protrusion is in the first installing portion, the first hook is caught by the first installing portion, wherein the second protrusion includes a second hook having flexibility, and wherein when the second protrusion is in the second installing portion, the second hook is caught by the second installing portion.

3. The ceiling fan of claim 1, wherein the upper lighting cover further includes a third protrusion protruding from the upper lighting cover towards the cover, wherein the cover further includes:

a third installing portion in which the third protrusion is fitted;

a second hole in which the third protrusion is positioned when the first protrusion is fitted in the first installing portion;

a fourth hole in which the third protrusion is positioned when the second protrusion is fitted in the second installing portion;

a fifth hole in which the first protrusion is positioned when the third protrusion is fitted in the third installing portion;

a sixth hole in which the second protrusion is positioned when the third protrusion is fitted in the third installing portion; and a second breaking portion around the second installing portion, the second breaking portion being capable of breaking, wherein when the cover with the second protrusion fitted in the second installing portion is detached from the upper lighting cover, the second breaking portion is broken, and wherein when the cover with the second breaking portion being broken is attached to the upper lighting cover, (i) the upper lighting cover and the cover are fixed together by the cover fixing portions, (ii) the third protrusion is fitted in the third installing portion, (iii) the first protrusion is positioned in the fifth hole, and (iv) the second protrusion is positioned in the sixth hole.

4. The ceiling fan of claim 3, wherein the third protrusion includes a third hook having flexibility, and wherein when the third protrusion is inserted in the third installing portion, the third hook is caught by the third installing portion.

* * * * *